US006386963B1

(12) United States Patent
Kenji et al.

(10) Patent No.: US 6,386,963 B1
(45) Date of Patent: May 14, 2002

(54) CONDITIONING DISK FOR CONDITIONING A POLISHING PAD

(75) Inventors: Suzuki Kenji, Narita; Raijiro Koga, Tsuchiura, both of (JP)

(73) Assignee: Applied Materials, Inc., Santa Clara, CA (US)

( * ) Notice: Subject to any disclaimer, the term of this patent is extended or adjusted under 35 U.S.C. 154(b) by 0 days.

(21) Appl. No.: 09/698,520

(22) Filed: Oct. 27, 2000

(30) Foreign Application Priority Data

Oct. 29, 1999 (JP) ..... 11-308103
Oct. 29, 1999 (JP) ..... 11-308104

(51) Int. Cl.[7] ..... B24B 21/18; B24B 33/00
(52) U.S. Cl. ..... 451/443; 451/56
(58) Field of Search ..... 451/56, 443, 285, 451/287, 288, 289, 494, 442, 444, 540, 548, 550; 15/21.1, 77, 88.2

(56) References Cited

U.S. PATENT DOCUMENTS 5,486,131 A * 1/1996 Cesna et al. ..... 451/56
5,626,509 A 5/1997 Hayashi ..... 451/285
5,667,433 A * 9/1997 Mallon ..... 451/494
5,725,417 A 3/1998 Robinson ..... 451/56
5,879,226 A 3/1999 Robinson ..... 451/287
5,913,715 A 6/1999 Kirchner et al. ..... 451/56
5,934,980 A 8/1999 Koos et al. ..... 451/41
5,941,762 A 8/1999 Ravkin et al. ..... 451/56
5,957,757 A 9/1999 Berman ..... 451/56
5,990,010 A 11/1999 Berman ..... 738/691
6,001,008 A * 12/1999 Fujimori et al. ..... 451/443
6,116,998 A * 9/2000 Damgaard et al. ..... 451/494
6,139,428 A * 10/2000 Drill et al. ..... 451/56
6,142,859 A * 11/2000 Ross et al. ..... 451/443
6,152,813 A * 11/2000 Suzuki ..... 451/443
6,162,112 A * 12/2000 Miazki et al. ..... 451/56

* cited by examiner

*Primary Examiner*—Derris H. Banks
(74) *Attorney, Agent, or Firm*—Moser, Patterson & Sheridan

(57) ABSTRACT

The present invention generally provides an apparatus and a method for conditioning a polishing pad in a polishing system. In one embodiment, the apparatus includes a conditioning disk having conditioning elements disposed on the bottom surface and away from the center portion of the disk. In another embodiment, the apparatus includes a base plate and a ring-shaped plate in which the conditioning elements are disposed on the ring-shaped plate. In still another embodiment, the apparatus includes a conditioning disk having conditioning elements disposed on the bottom surface and away from the center portion of the disk and having brush bristles disposed on the center portion of the disk.

20 Claims, 5 Drawing Sheets

CONDITIONING DISK FOR CONDITIONING A POLISHING PAD

BACKGROUND OF THE INVENTION

This application claims priority to Japanese Patent Application H11-308103 and H11-308104, both filed Oct. 29, 1999.

1. Field of the Invention

The present invention relates to an apparatus and a method for conditioning a polishing pad in a polishing system.

2. Background of the Related Art

In semiconductor wafer processing, the use of chemical mechanical planarization, or CMP, has gained favor due to the enhanced ability to increase device density on a semiconductor workpiece, or substrate, such as a wafer. As the demand for planarization of layers formed on wafers in semiconductor fabrication increases, the requirement for greater system (i.e., process tool) throughput with less wafer damage and enhanced wafer planarization has also increased.

In an exemplary CMP system, a planarization system is supplied wafers from cassettes located in an adjacent liquid filled bath. A transfer mechanism, or robot, facilitates the transfer of the wafers from the bath to a transfer station. The transfer station generally contains a load cup that positions wafers into one of four processing heads mounted to a carousel. The carousel moves each processing head sequentially over the load cup to receive a wafer. As the processing heads are loaded, the carousel moves the processing heads and wafers through the planarization stations for polishing. The wafers are planarized by moving the wafer relative to a polishing material in the presence of a slurry or other polishing fluid medium. The polishing material may include an abrasive surface. The slurry typically contains both chemicals and abrasives that aid in the removal of material from the wafer. After completion of the planarization process, the wafer is returned back through the transfer station to the proper cassette located in the bath.

Conventional polishing material is generally comprised of a foamed polymer, such as polyurethane, having a textured, grooved, or porous surface. The textured or porous surface functions to retain the polishing fluid that normally contains abrasive slurry on the polishing pad during the polishing operation. The abrasives in the slurry provide the mechanical component of the planarization process which planarizes (i.e., polishes) the substrate in concert with chemical agents present in the polishing fluid.

Both conventional and fixed abrasive polishing materials are generally available in stick-down pads or in the form of a web. Generally, the web is periodically advanced over the course of polishing a number of substrates as the polishing surface of the web is consumed by the polishing process. Conventional polishing materials generally wear during polishing, causing the surface of the polishing material to loose its ability to adequately retain polishing fluid during the polishing process. The resulting non-uniformity of polishing fluid across the conventional polishing material consequently results in variation of the polishing results.

To maintain uniform polishing results, the conventional stick-down pads and webs of polishing material are periodically conditioned by a conditioning disk to return the polishing surface to a condition wherein consistent polishing results can be obtained. Typically, the conditioning disk is covered over its entire bottom surface with a diamond coating. The conditioning disk is rotated so that the bottom surface contacts the polishing surface of the polishing pad. The conditioning disk is connected to an arm so that conditioning disk may be moved to contact the entire polishing surface of the polishing pad.

In the case of fixed abrasive polishing materials, the polishing material is initially conditioned to remove a layer of resin generally disposed at the surface of the polishing material to expose some of the abrasive particles disposed therein. Fixed abrasive webs are incrementally indexed across the area where polishing is performed to remove portions of the web that may have become worn, replacing those portions with an unused portion of the web. Each time an unused portion of web is indexed to the polishing area, that portion of the web must be conditioned to expose the abrasive particles and transform the web to a state where polishing in the unused portion of the web is substantially uniform to the other portions of the web within the polishing area.

A concern during conditioning is particulate generation. Particles formed from either the pad or conditioner may be left on the pad after conditioning. Any individual particle may later scratch the substrates during polishing, creating a potential defect in the substrate or contributing to polishing non-uniformity. For example, a particle disposed on the polishing material may create a high spot that locally concentrates the forces between the polishing material and the substrate. This high force concentration can cause the particle to scratch the substrate. If large numbers of particles are present on the polishing material, local disparities in polishing rates may result in polishing non-uniformities. Moreover, when using fixed abrasive polishing materials, the high force concentration is aggravated by the lower surface contact area between the polishing material and the substrate (about 18 percent for some fixed abrasive materials). This may create excessive shear forces over the particle which may shear the abrasive elements underlying the particle, damaging the polishing material and thus causing scratching.

Therefore, there is a need for an improved apparatus and method for conditioning a polishing pad.

SUMMARY OF THE INVENTION

The present invention generally provides an apparatus and a method for conditioning a polishing pad in a polishing system. In one embodiment, the apparatus includes a conditioning disk having conditioning elements disposed on the bottom surface and away from the center portion of the disk. In another embodiment, the apparatus includes a base plate and a ring-shaped plate in which the conditioning elements are disposed on the ring-shaped plate. In still another embodiment, the apparatus includes a conditioning disk having conditioning elements disposed on the bottom surface and away from the center portion of the disk and having brush bristles disposed on the center portion of the disk.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

The apparatus and method of conditioning a polishing surface of a polishing pad can be performed on a variety of polishing systems, such as the MIRRA™, the MIRRA MESA™, and the REFLECTIONS™ systems, available from Applied Materials, Inc. of Santa Clara, Calif. Other systems that may be used to advantage include systems that use polishing pads, polishing webs, or a combination thereof and/or systems that move a substrate relative to a polishing surface in a rotational, linear, or other motion.

Figure 1:
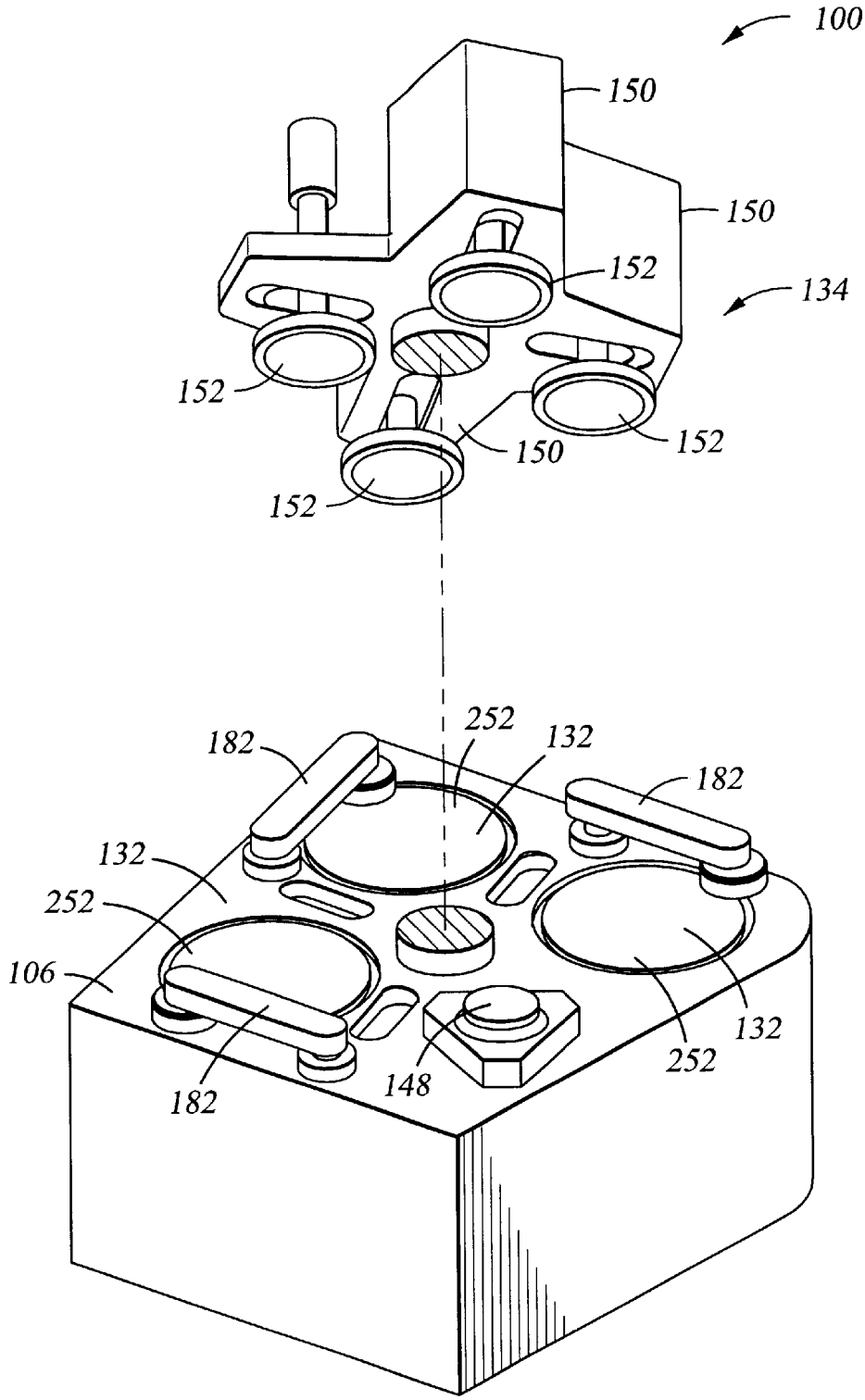
FIG. 1 is perspective of one embodiment of a chemical mechanical planarization system.

FIG. 1 is a perspective view of a MIRRA™ planarization system 100, generally described in U.S. Pat. No. 5,738,574, issued Apr. 15, 1998, by Tolles et al., which is incorporated by reference in its entirety. The system generally includes three polishing stations 132 and a loading station 148 disposed on a baseplate 106. A conditioning device 182, which will be described in greater detail below, is disposed proximate the polishing stations 132. A carousel 134 having four arms 150 is centrally disposed on the baseplate 106 whereby each arm 150 supports a substrate carrier 152 and positions each substrate carrier 152 over the loading station 148 or over one of the polishing stations 132.

The carousel 134 is rotatable to move the substrate carriers 152 from one loading station 148 or polishing stations 132 to another. Generally, the process of polishing a substrate comprises having a substrate loaded into each substrate carrier 152. The substrate carriers 152 move the substrates from the loading station 148 to each polishing station 132 for processing and back to the loading station 148 to be unloaded. Polishing pads 252 may be disposed on the three stations 132. Alternatively, polishing pads may be disposed on the first two stations and a cleaning pad may be disposed on the third station to facilitate substrate cleaning at the end of the polishing process.

Disposed on the baseplate 106 adjacent to each polishing station 132 is at least one rinse arm (not shown) which is adapted to deliver a polishing fluid and/or a cleaning fluid to the top surface of the polishing stations 132. Generally, a chemical mechanical polishing process is performed at each polishing station 132. The process typically includes moving a substrate disposed in the substrate carrier 152 against the polishing pad 252 in a predetermined motion in the presence of a polishing fluid. The polishing fluid can comprise chemical polishing agents, de-ionized water, abrasive particles, or a combination thereof to provide the chemical component and mechanical component of the polishing process. Alternatively, the polishing pad can provide the abrasive particles and/or chemical polishing agents. The cleaning fluid typically comprises de-ionized water or other fluids to remove any debris, loose material, or other contaminates from the abrasive elements or from the upper surface of the polishing pad.

Figure 2:
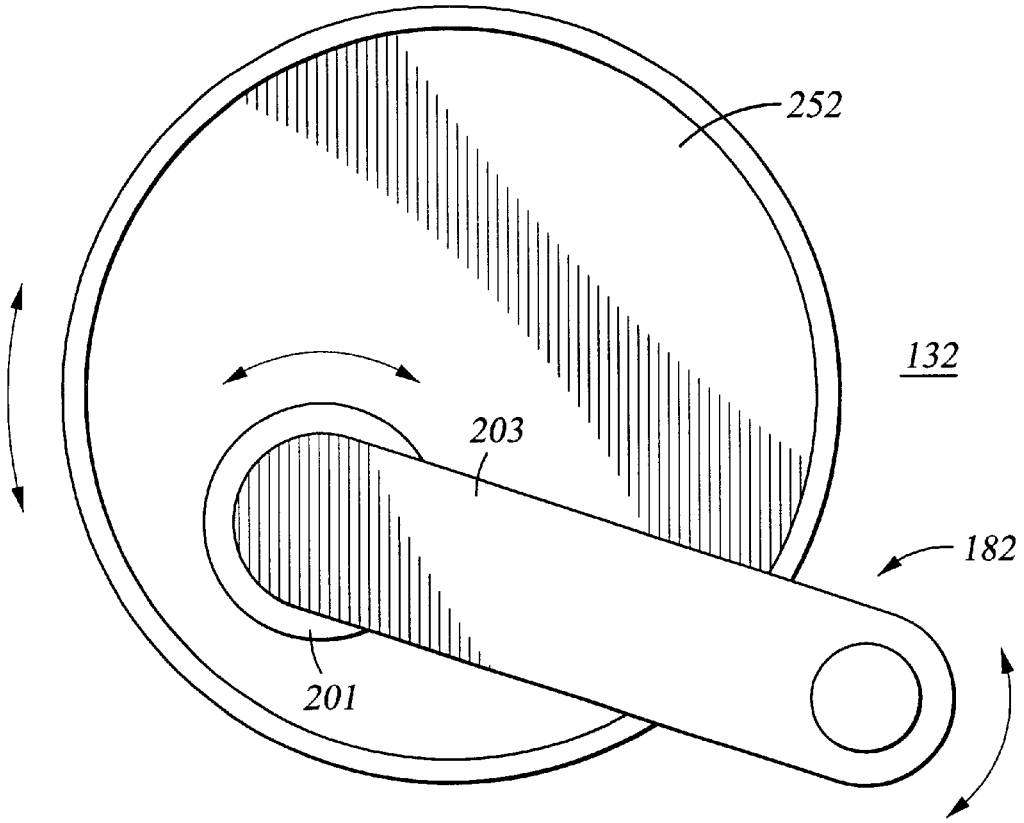
FIG. 2 is a top plan view of a polishing station and a conditioning device.

As shown in FIG. 2, which is a top plan view of a polishing station 132, a polishing pad 252 is disposed on the polishing station 132. The polishing pad 252 as shown is a stick-down pad. However, alternatively, other CMP systems may utilize polishing pads in the form of a web or sheet of polishing material that may be advanced across the polishing surface. The polishing pad 252 may have a smooth surface, a textured surface, a surface containing a fixed abrasive, or a combination thereof. Fixed abrasive polishing material typically comprises a plurality of abrasive particles suspending in a resin binder that is disposed in discrete elements on a backing sheet. The polishing station 132 generally comprises a platen supported by a bearing so that the platen may rotate. The platen is typically coupled to a motor that provides the rotational motion to the platen. The motor is driven by the controller such that the speed, acceleration, and rotational direction of the motor may be controlled.

The conditioning device 182 is disposed adjacent each polishing station 132. The conditioning device 182 comprises a conditioning disk 201 disposed on the end of an arm 203. Generally, the bottom surface of the conditioning disk 201 contacts the polishing surface of the polishing pad 252 during conditioning. Unlike other rotating conditioning devices having an axis of rotation parallel to the polishing material and that tangentially contact the polishing surface, the conditioning disk 201 provides a large contact area and conditions the polishing pad 252 rapidly and uniformly. The arm 203 provides translational motion to the conditioning disk 201 so that the conditioning disk 201 may contact the entire polishing surface of the polishing pad 252. Furthermore, a rotation device may be coupled to the arm 203 and the conditioning disk 201 to rotate the conditioning disk during conditioning. The polishing station 132 may also be rotated during conditioning. In addition, a lift mechanism may be coupled to the arm 203 to control the elevation of the conditioning device 182. The lift mechanism has a range of motion that allows the conditioning device 182 to be raised clear of the pad 252 and platen, or to place the conditioning disk 201 in contact with the polishing pad 252.

The conditioning disk 201 is generally orientated substantially planar and substantially parallel to the polishing pad 252 during conditioning. Substantially planar is intended to mean that the conditioning disk 201 has a generally planar orientation even though a surface of the conditioning disk 201 that contacts the polishing pad 252 may have a surface roughness, texture, grooves, flutes, or embossing. Substantially parallel is intended to mean that the surface of the conditioning disk 201 that contacts the polishing pad 252 is coplanar or within a few degrees of parallel to the polishing surface of the polishing pad 252.

Figure 3:
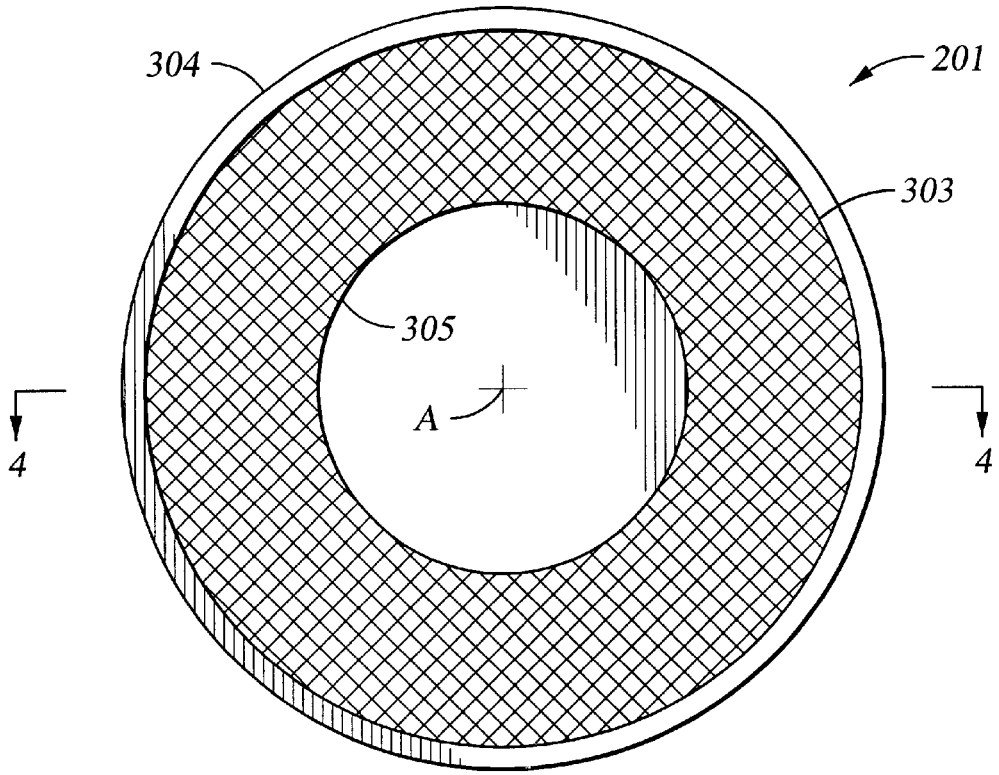
FIG. 3 is bottom view of one embodiment of a conditioning disk.
Figure 4:
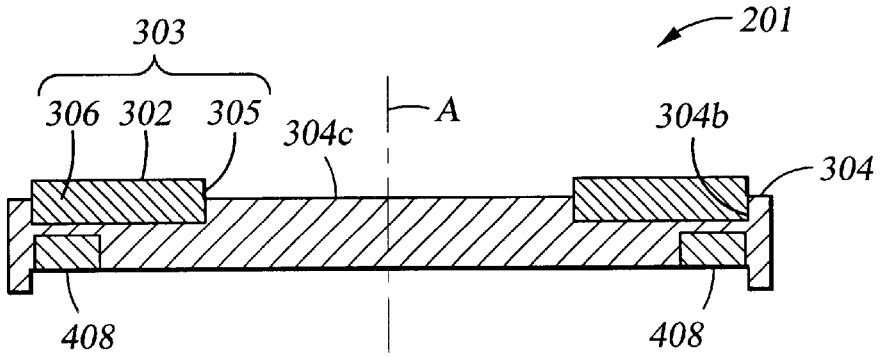
FIG. 4 is a side cross-sectional view of the conditioning disk of FIG. 3.

As shown in FIG. 3, which is a bottom view of one embodiment of the conditioning disk 201, and FIG. 4, which is a side cross-sectional view of the conditioning disk 201 of FIG. 3, the conditioning disk 201 comprises a base plate 304 and a ring-shaped plate 303 attached thereto. The ring-shaped plate 303 comprises a backing panel 306 with conditioning elements 302 disposed thereon. The ring-shaped plate 303 has a hole 305. Thus, conditioning elements 302 are provided in an annular shape on the conditioning disk and at a different elevation than the base plate 304. Alternatively, while using a ring-shaped plate 303 having a hole 305 in the center has been described, it is possible to a plate having conditioning elements arranged in an annular fashion on a plate not having a hole.

Generally, the conditioning elements 302 are selected to provide a desired result during planarization. The conditioning elements 302 typically comprise diamond coating, oxide, ceramic, copper, silicon carbide, photoresist, plastic or a combination thereof. Preferably, the conditioning elements 302 comprise a diamond coating. The conditioning elements 302 may be smooth or alternatively textured. The conditioning elements 302 may be textured by coating, abrading, embossing, machining, etching, or other methods which provide a textured surface. With such textured surfaces it may be desirable to harden or process the surface to extend the service life of the conditioning elements 302. Examples of such hardening or other surface processes include induction heating, carbonizing, nitriding, ion-nitriding, or by the application of surface coatings such as quartz, aluminum oxide, silicon carbide, cubic boron nitride, or other protective coatings.

In one embodiment, the ring-shaped plate 303 may be composed of a magnetic material such as iron. Thus, magnets 408 (as shown in FIG. 4) may be embedded the base plate 304 to magnetically attach the ring-shaped plate 303 to the base plate 304 at a single touch.

Figure 5:
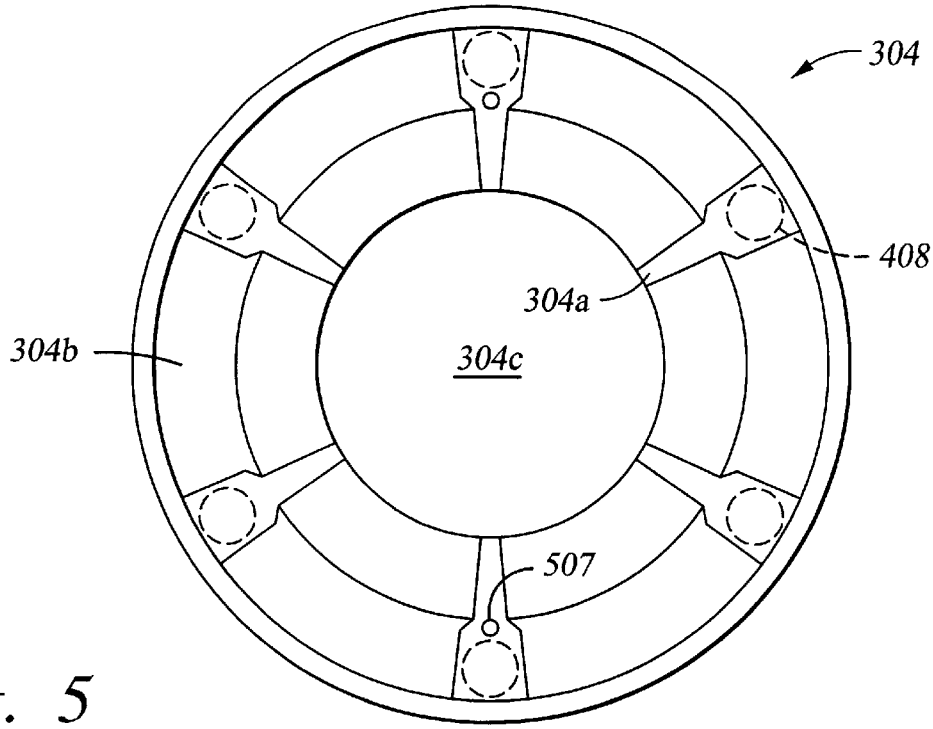
FIG. 5 is a,bottom view of one embodiment of the base plate of the conditioning disk.

FIG. 5 is a bottom view of one embodiment of the base plate 304 of the conditioning disk 201 without the ring-shaped plate 303. The base plate 304 comprises a plastic member formed into a wheel shape with a plurality of limbs 304*a*. The base plate 304 may include a positioning bump 507 to be fitted into a positioning hole (not shown) formed in the ring-shaped plate 303 for positioning the base plate 304 and ring-shaped plate 303 together and for preventing relative rotation between the base plate 304 and the ring-shaped plate 303. As shown in FIGS. 4 and 5, the base plate 304 can further comprises a ring-shaped concave portion 304*b* into which the ring-shaped plate 303 can be fitted and a fitting convex portion 304*c* which is fitted into the hole 305 of the ring-shaped plate 303. The convex portion 304*c* helps prevent corrosion of the backing panel 306 due to contact with the slurry.

The polishing surface of the polishing pad is conditioned by contacting the conditioning disk 201 with the polishing pad 252 while the conditioning disk 201 is rotated horizontally and/or translated across the polishing pad. Additionally, the polishing pad may be rotated or otherwise moved in relation to the conditioning disk 201. It has been observed that the conditioning disks 201 results in more effective removal of the particles residing on the surface of the polishing surface of the polishing pad.

Since the conditioning elements 302 are arranged in an annular shape on the ring-shaped plate 303 at a different elevation than the base plate 304, the conditioning elements 302 contact the polishing pad with a higher contact pressure than conventional conditioning disks having conditioning elements disposed on their entire surface. Additionally, since the conditioning elements 302 are disposed away from the central portion of the conditioning disk or away from the rotational axis of the conditioning disk, the conditioning elements 302 have a greater tangential velocity due to the rotation of the conditioning disk when compared to conditioning elements disposed on the center of a conditioning disk. Not wishing to be bound by a particular theory, the conditioning performance of the conditioning disk 201 is improved because of the higher contact pressure and the greater tangential velocity of the conditioning elements 302. The conditioning performance is not substantially impaired by removing conditioning elements 302 from the center portion of the conditioning disk 201 because the speed imparted to the conditioning elements disposed at the center portion of the conditioning disk is small and therefore, the conditioning effect of these conditioning elements is small.

It also believed that the higher contact pressure and greater tangential velocity result in an increased scooping of particles residing on the polishing pad. Furthermore, it is believed that because hole 305 is formed in the ring-shaped plate 303, the surface of the polishing pad which is brought into contact with the ring-shaped plate 303 changes according to changes in contact pressure between the peripheral portions on which the conditioning elements 302 are disposed and the central portion on which the through hole 305 is formed. These changes of pressure aid in the scooping of particles created during polishing or conditioning processes. In addition, the conditioning ability and ability to remove particles can be improved by increasing the spacing between particles of the conditioning elements 302 on the conditioning disk 201. Thus, the conditioning disk reduces the occurrence of microscratches on the surface of substrates being polished.

Figure 6:
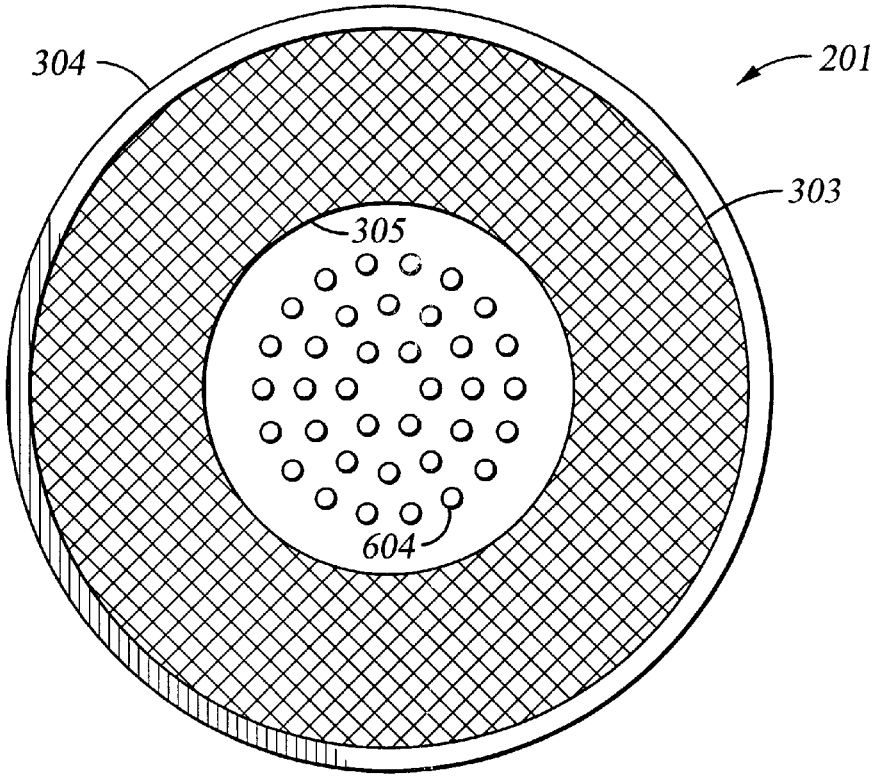
FIG. 6 is a bottom view of one embodiment of a conditioning disk with brush bristles.

FIGS. 6, which is a bottom view of one embodiment of a conditioning disk, the conditioning disk 201 may further include brush bristles 604 disposed in the center of the conditioning disk 201. The brush bristles 604 are preferably disposed in a plurality of bundles disposed at a plurality of locations in the center of the conditioning disk 201.

Figure 8:
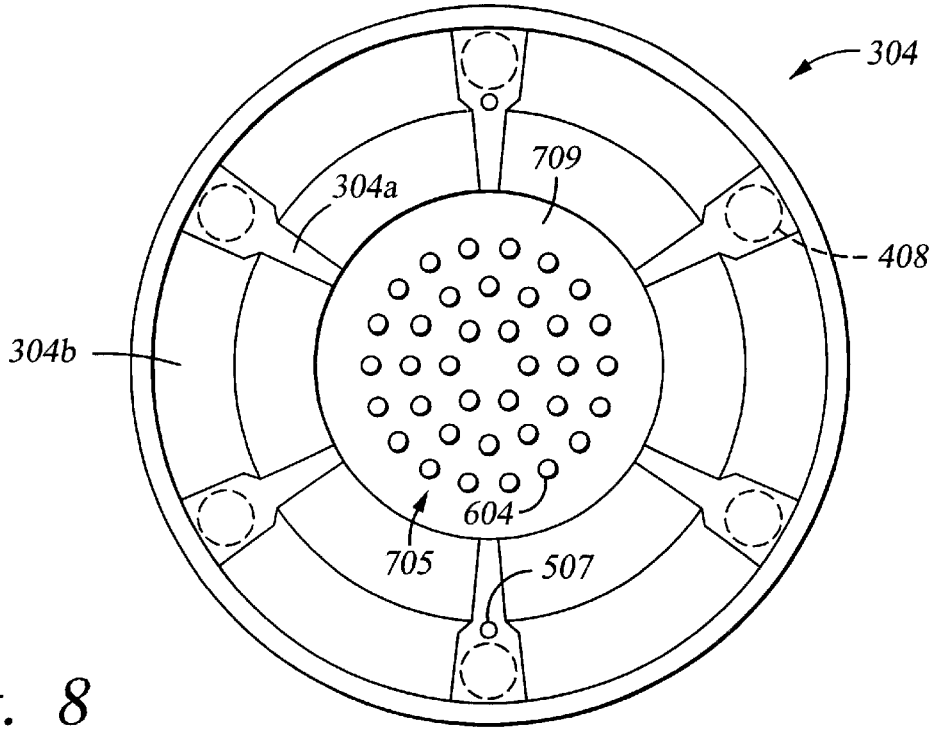
FIG. 8 is a bottom view of one embodiment of the base plate of the conditioning disk with brush bristles.
Figure 7:
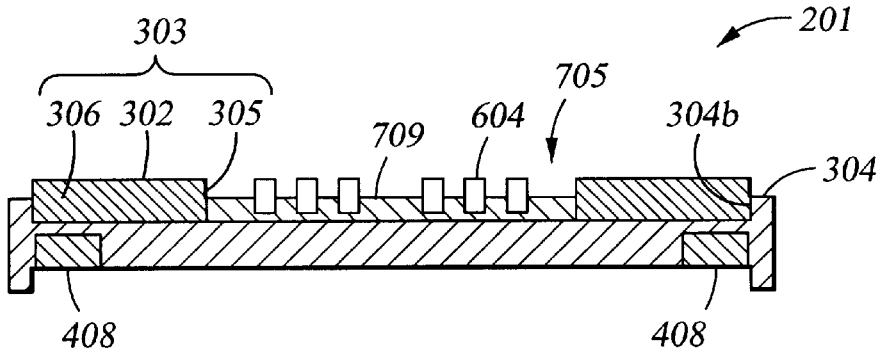
FIG. 7 is a side cross-sectional view of another embodiment of the conditioning disk with brush bristles.

As shown in FIG. 7, which is a side cross-sectional view of another embodiment of the conditioning disk, and, as shown in FIG. 8, which is a bottom view of one embodiment of the base plate of the conditioning disk, the conditioning disk 201 may include a brush plate 705 with brush portion 709. The brush portion 709 has a plurality of brush bristles 604 and may be inserted through hole 305 of the ring-shaped plate 303. The brush plate 705 may be fixedly or releasably attached to the base plate 304. Preferably, the brush plate is attached using adhesives. In another embodiment, the brush plate may be molded and formed integrally with the base plate 304.

With conditioning elements 302 disposed in an annular shape and brush bristles 604 disposed in the center portion of the conditioning disk 201, the disk both conditions a polishing pad and brushes or scoops out particles generated in the polishing or conditioning process by use of the brush bristles 604. By translational movement of the conditioning disk 201, by horizontal rotation of the conditioning disk 201, and/or by rotation of the polishing surface of a polishing pad, the conditioning elements 302 disposed in an annular shape condition the polishing pad while the brush bristles 604 scoop out particles which have entered concavities or grooves in the polishing pad.

As a result, by removing particles generated in the polishing or conditioning process, the occurrence of microscratches on the surface of the wafer being polished can be effectively reduced. Furthermore, the cleaning of particles which is conventionally performed in a separate procedure can be eliminated, thus reducing the number of processing steps and increasing the throughput of the substrates. Additionally, since according to one embodiment of the conditioning disk 201, in which the ring-shaped plate 303 is composed of iron and magnets 408 are embedded in the base plate 304, the assembly of the conditioning disk 201 and replacement of the ring-shaped plate may be performed quickly and easily.

In the embodiments discussed above, the specific shapes and materials of each constituent part has been described, but the present invention is of course not restricted to these, and any shape or material may be selected as needed. The foregoing is directed to the preferred embodiments of the present invention, other and further embodiments of the invention may be devised without departing from the basic scope thereof, and the scope thereof is determined by the claims that follow.

What is claimed is:

1. An apparatus for conditioning a polishing surface of a polishing pad, comprising:

a disk comprising a base plate and a conditioning plate releasably attached thereto by at least one magnet; and conditioning elements disposed on a bottom surface of the conditioning plate and away from a center portion of the conditioning plate.

2. The apparatus of claim 1, wherein the conditioning elements are disposed in an annular shape on the bottom surface of the conditioning plate.

3. The apparatus of claim 2, wherein the conditioning plate comprises a ring-shaped plate.

4. The apparatus of claim 3, wherein the conditioning elements are disposed on the ring-shaped plate at a different elevation than the base plate.

5. The apparatus of claim 3, wherein the ring-shaped plate has a hole free of any conditioning elements.

6. The apparatus of claim 1, wherein the conditioning elements comprise a diamond coating.

7. The apparatus of claim 1, wherein the at least one magnet is embedded in the base plate.

8. The apparatus of claim 7, wherein the conditioning plate comprises a magnetic material.

9. The apparatus of claim 8, wherein the conditioning plate comprises iron.

10. An apparatus for conditioning a polishing surface of a polishing pad, comprising:

a disk having a bottom surface and a center portion;

conditioning elements disposed on the bottom surface of the disk and away from the center portion of the disk; and brush bristles disposed at the center portion of the disk and on the bottom surface of the disk.

11. The apparatus of claim 10, wherein the conditioning elements are disposed in an annular shape on the bottom surface of the disk.

12. The apparatus of claim 10, wherein the conditioning elements comprise a diamond coating.

13. An apparatus for conditioning a polishing surface of a polishing pad, comprising:

a disk comprising a base plate and a ring-shaped plate attached thereto;

conditioning elements disposed in an annular shape on the ring-shaped plate; and brush bristles disposed through a hole of the ring-shaped plate.

14. The apparatus of claim 13, wherein the brush bristles are disposed on the base plate.

15. The apparatus of claim 13, wherein the brush bristles are disposed on a brush plate attached to the base plate.

16. The apparatus of claim 13, wherein the conditioning elements comprise a diamond coating.

17. The apparatus of claim 13, further comprising at least one magnet releasably attaching the base plate and the ring-shaped plate.

18. The apparatus of claim 17, wherein the at least one magnet is embedded in the base plate.

19. The apparatus of claim 18, wherein the ring-shaped plate comprises a magnetic material.

20. The apparatus of claim 19, wherein the ring-shaped plate comprises iron.

* * * * *